US008474385B2

(12) United States Patent
Saito

(10) Patent No.: US 8,474,385 B2
(45) Date of Patent: Jul. 2, 2013

(54) TABLE AND METHOD OF ASSEMBLING THE SAME

(75) Inventor: Takayuki Saito, Kasugai (JP)

(73) Assignee: Aichi Co., Ltd., Aichi-Ken (JP)

( * ) Notice: Subject to any disclaimer, the term of this patent is extended or adjusted under 35 U.S.C. 154(b) by 299 days.

(21) Appl. No.: 12/910,257

(22) Filed: Oct. 22, 2010

(65) Prior Publication Data

US 2011/0290159 A1 Dec. 1, 2011

(30) Foreign Application Priority Data

May 28, 2010 (JP) ..... 2010-122964

(51) Int. Cl.
*A47B 3/00* (2006.01)

(52) U.S. Cl.
USPC ..... 108/115

(58) Field of Classification Search
USPC .... 108/115, 6–8, 91; 248/129, 98; 280/43.14, 280/43.24
See application file for complete search history.

(56) References Cited

U.S. PATENT DOCUMENTS

| | | | | |
|---|---|---|---|---|
| 1,916,537 | A * | 7/1933 | Roy | 108/8 |
| 2,271,007 | A * | 1/1942 | Cortis | 297/140 |
| 4,067,266 | A * | 1/1978 | Lafargue | 108/172 |
| 2007/0261609 | A1* | 11/2007 | Kumazawa | 108/6 |

FOREIGN PATENT DOCUMENTS

| | | | |
|---|---|---|---|
| JP | 5 068618 | A | 3/1993 |
| JP | 2000262330 | * | 9/2000 |
| JP | 2001 061557 | A | 3/2001 |
| JP | 2003 259918 | A | 9/2003 |
| JP | 2004-357979 | A | 12/2004 |
| JP | 2008 104793 | A | 5/2008 |

OTHER PUBLICATIONS

European Patent Office. Extended European Search Report issued in the European Patent Application No. 10013920.3. Sep. 26, 2011. pp. 8.

* cited by examiner

*Primary Examiner* — Janet M Wilkens
(74) *Attorney, Agent, or Firm* — Davis & Bujold, PLLC

(57) ABSTRACT

A table includes a pair of leg portions that has a length in a vertical direction and is hollow in shape with an opening formed at the top end thereof; a top panel that is mounted rotatably; a pair of casters, at least one such casters being provided at each of the front and the rear of a base portion of the leg portion; a contact portion that is provided on the base portion of the leg portion; and a raising/lowering mechanism that couples a movable portion, which is either one or more of the pair of casters and the contact portion, and the top panel, and switches what comes into contact with a floor surface between the pair of casters and the contact portion by raising/lowering the movable portion in accordance with a rotation of the top panel. The raising/lowering mechanism couples the top panel and the movable portion through the opening.

12 Claims, 5 Drawing Sheets

TABLE AND METHOD OF ASSEMBLING THE SAME

CROSS-REFERENCE TO RELATED APPLICATIONS

This application claims the benefit of Japanese Patent Application No. 2010-122964 filed May 28, 2010 in the Japanese Patent Office, the disclosures of which are incorporated herein by reference.

BACKGROUND OF THE INVENTION

The present invention relates to a table including a rotatable top panel.

Conventionally, a table having a rotatable top panel is used in an office or at school. Such a table is put into an in-use state when the top panel is set substantially horizontally. In contrast, when the top panel is set up substantially vertically, the table is put into a storable state where a plurality of the tables can be stacked in a front-back direction for storage purposes. Some of such tables have casters arranged at the lower end thereof, and are configured to be switchable between a movable state by means of the casters and an immovable state in an interlocking manner with the rotation of the top panel.

In the above-described table, the top panel is supported by a pair of leg portions arranged spaced apart from each other. Therefore, in order to increase strength of the table and allow the same to be used in a stable condition, a frame member that couples the leg portions to each other is provided.

Since the frame member is arranged between the leg portions, the space for accommodating the user's legs is narrowed by the frame member. To cope with this, a table is proposed in which the frame member is arranged between the upper parts of the leg portions and used also as a rotation axis of the top panel. Such a configuration secures the space for accommodating the user's legs and increases strength of the table. As an example of such tables, proposed is a table in which, for example, the frame member (rotational support shaft) is bridged laterally between the top edges of the leg portions (leg supports), and the side edges of the rotational support shaft are positioned outside of the inside edges of the leg supports (see Japanese Unexamined Patent Application Publication No. 2004-357979).

Conventionally, a movable state by means of the casters and an immovable state are switched in an interlocking manner with the rotation of the top panel due to a configuration, for example, in which a rod arranged inside the leg portion is moved up and down in accordance with the rotation of the top panel, and the movement of the rod switches between an abutting state and a non-abutting state of the casters against a floor surface.

In such a configuration, if the rotation axis of the top panel is not the frame member as stated above, the up-and-down movement of the rod can be achieved by coupling the rotation axis of the top panel and the rod via a small number of components. Thus, this mechanism can be simplified and downsized.

In the case of a table in which a frame member functions as a rotation axis, however, it is preferable that the frame member is non-rotatably fixed to the leg portions to retain strength because the frame member is provided in order to reinforce the table. Consequently, in order to allow the rod to be moved up and down, it becomes necessary to connect the top panel and the rod, and to additionally attach members for converting the rotation of the top panel to the up-and-down movement of the rod.

In the table in the above Japanese Unexamined Patent Application Publication No. 2004-357979, as shown in FIG. 2 and FIG. 6 thereof, a rod-like member is arranged on a side surface of a top-panel-receiver 32 and coupled to a rod inside a leg support 21 via a shaft-like member arranged in such a manner as to penetrate an inner surface of the leg support 21. Further, as can be seen from FIG. 4 of the above publication, the shaft-like member is moved up and down in accordance with a rotational position of a top panel 1.

SUMMARY OF THE INVENTION

In the table in the above publication, the rod-like member might come into contact with a leg of the user because the rod-like member is moved up and down on the inside of the leg portion. Further, the leg portion needs to have elongated holes and notches formed thereon which are required for the shaft-like member to move. This decreases strength of the leg portion and, moreover, a part of the use's body, clothes or the like may get caught in the elongated holes and so on.

The present invention has been developed in view of the foregoing problems, and it is an object of the present invention to provide a table having leg portions with higher strength and a lower risk of catching a part of the user's body or the like on the side of the leg portion, and a method of assembling the table.

According to a first aspect of the present invention, there is provided a table that includes a pair of leg portions and a top panel, and is switchable between a movable state by means of casters and an immovable state in accordance with a rotational position of the top panel. The leg portion has a length in a vertical direction, and is hollow in shape with an opening formed at the top end thereof. The top panel is mounted rotatably.

On the base portion of the leg portion, the casters and a contact portion are arranged, which are switchably brought into contact with a floor surface by means of a raising/lowering mechanism. At least one such caster is provided at each of the front and the rear of the leg portion. The contact portion operates to suppress the movement of the table by contacting the floor surface, and one or more contact portions are preferably provided on the leg portion.

The raising/lowering mechanism couples a movable portion, which is either one or more of the pair of casters and the contact portion as described above, and the top panel. What comes into contact with the floor surface is switched by the raising/lowering of the movable portion in accordance with the rotation of the top panel. In a case where the movable portion is the contact portion, for example, when the contact portion is raised, the caster is moved downward relative to the contact portion, and contacts the floor surface to make the table movable. In contrast, when the contact portion is lowered, the contact portion contacts the floor surface to make the table immovable. The movable portion may be the caster. In such a case, the plurality of casters may be raised/lowered, or only either one of the casters at the front or at the rear may be raised/lowered, for example.

More specifically, the above raising/lowering mechanism couples the top panel and the movable portion through the opening at the top end of the leg portion.

Accordingly, in the table configured as above, it is not necessary to form holes or notches on the side of the leg portion so as not to hinder the movement of the raising/lowering mechanism. As a result, the strength of the leg portion can be kept high.

Further, since the components moving on the side of the leg portion become unnecessary, a situation where the user's legs come into contact with such components does not occur. Accordingly, there is no possibility that a part of the use's body, clothes or the like may get caught in interspaces between the components and the structure of the leg portion or the top panel, or in interspaces between the components and the holes or notches. In short, a risk of getting caught at the side of the leg portion can be reduced.

The coupling between the top panel and the movable portion as described above means that each of the constituents such as the raising/lowering mechanism, the top panel, the movable portion and others is arranged in such a manner that the rotation of the top panel is interlocked with the raising/lowering movement of the movable portion. In other words, each of the constituents does not need to be continuously in contact with each other. For example, a constituent may be included which is configured not to contact the top panel when the top panel is in a horizontal position but to contact the top panel to transmit the rotation when the top panel rotates to a vertical position.

The above-described configuration of the first aspect of the present invention can be applied to various types of tables, and may be applied to a table that includes a frame member, which couples a pair of the leg portions and is formed as a cylindrical portion, at least a part of which is cylindrically shaped, and in which the top panel rotates about the cylindrical portion.

In the table configured as such, the frame member can be arranged at the upper part to secure wider space for accommodating the user's legs. Further, even in a case where the rotation axis cannot be utilized as a part of the raising/lowering mechanism by using the frame member as a rotation axis (i.e., in a case where additional members are required which convert the rotation of the top panel to the raising/lowering movement of the rod), deterioration of strength of the leg portion can be suppressed and the risk of getting caught at the side of the leg portion can be reduced.

The above-described raising/lowering mechanism may be variously configured as long as the movable portion can be raised/lowered. For example, the raising/lowering mechanism may be configured to include a top-panel-coupling member that couples to the top panel, a rod that is arranged inside the leg portion and couples to the movable portion, a support shaft that is fixed to the leg portion in parallel with an axis line of a rotation axis of the top panel, and a rotary member that is rotatably supported by the support shaft and couples to the top-panel-coupling member and to the rod.

In such a raising/lowering mechanism, the rotary member rotates in accordance with the rotation of the top panel, and the rotation of the rotary member moves the rod up and down. The movement of the rod enables the movable portion to be raised/lowered.

The above-described support shaft may be arranged substantially coaxially with the cylindrical portion.

In the table configured as such, the rotary member rotates coaxially with the top panel. If the axis of the rotary member does not correspond to the axis of the top panel, i.e., if the axes are not coaxial, the positional relationship between the top panel and the rotary member varies when the top panel and the rotary member are coupled to each other and the rotary member is rotated in accordance with the rotation of the top panel. Therefore, the top-panel-coupling member is required to be configured changeable in formation in accordance with the change in the positional relationship between the top panel and the rotary member. For example, it is necessary to configure the top-panel-coupling member as a link mechanism, in which the top-panel-coupling member is combined with a plurality of components. Alternatively, it is necessary to couple the top-panel-coupling member to the top panel or the rotary member in such a manner that the length may be variable by sliding. As a result, more space is required for the movement of the top-panel-coupling member, whereby it becomes difficult to arrange the raising/lowering mechanism inside the leg portion.

However, in the above-described table with the support shaft arranged substantially coaxially with the cylindrical portion, the rotary member and the top panel rotate coaxially with each other, and the rotary member rotates without changing the positional relationship thereof with the top panel. Therefore, it is not necessary for the top-panel-coupling member to be changeable in formation. This reduces the space for the movement of the top-panel-coupling member in accordance with the rotation of the top panel (i.e., the space required for the top-panel-coupling member to move). As a result, the top panel and the movable portion can be easily coupled through the opening of the leg portion, and a space-saving design of the raising/lowering mechanism and a reduced risk of catching a part of the user's body or the like can be achieved.

In the above-described table, the top panel and the leg portion may be arranged in such a manner that the axis line of the rotation axis of the top panel passes through the center of the opening at the top end of the leg portions when viewed from above.

In the table configured as such, since constituents of the raising/lowering mechanism are easily housed into the opening of the leg portion by arranging the raising/lowering mechanism on the rotation axis of the top panel, a portion sticking out of the leg portion can be reduced.

In the above-described table, it is preferable to provide a cover member that covers the top of the leg portion and the raising/lowering mechanism.

The table configured as such makes it possible to reduce the risk of catching a part of the user's body in the opening or the raising/lowering mechanism when, for example, the top panel is rotated, because the opening provided at the top of the leg portion and the raising/lowering mechanism are covered with the cover member.

In the above-described table, it is preferable that the center of gravity of the top panel is positioned on the axis line of the cylindrical portion when viewed from above.

In the table configured as such, the top panel can be supported by the leg portions from underneath the center of gravity of the top panel and, therefore, the table is well balanced as a whole. Accordingly, the table can be used in a stable condition, and the top panel can be rotated smoothly.

A second aspect of the present invention relates to a method of assembling a table. The term "table" here is the table according to the first aspect.

This assembling method includes a coupling step for coupling the raising/lowering mechanism and the top panel by inserting the top-panel-coupling member, which has been preliminarily mounted on any one of the top panel and the rotary member, into an inserted portion formed on the other one of the top panel and the rotary member in such a manner as to move the top-panel-coupling member in parallel with the axis line of the rotation axis of the top panel.

Such a method of assembling the table enables the table to be easily assembled. The inserted portion can be formed in various shapes as long as the top-panel-coupling member can be inserted thereinto. For example, the inserted portion may be a hole or a notch, into which the top-panel-coupling member can be inserted.

BRIEF DESCRIPTION OF THE DRAWINGS

Hereinafter, an embodiment as the best mode for carrying out the present invention will be described in detail with reference to the drawings, in which.

DETAILED DESCRIPTION OF THE PREFERRED EMBODIMENTS

It is to be appreciated that embodiments described hereinafter are only exemplifications and that the present invention can be implemented in various embodiments other than those described hereinafter.

(1) General Configuration

Figure 1C:
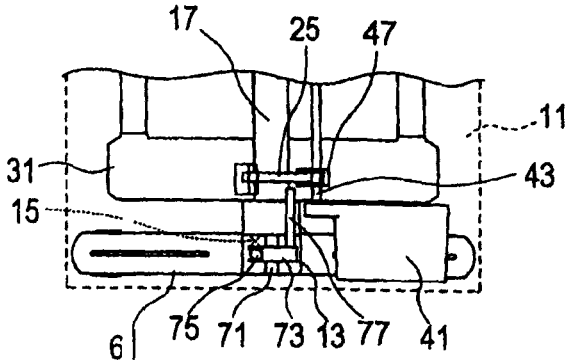
FIG. 1C is a schematic diagram showing an arrangement of main components of the table when viewed from above.

A table 1 of the present embodiment is shown in FIGS. 1A-1C and FIG. 2. FIG. 1C is a schematic view in a case where some components such as a top panel 11 are seen through. Since the table 1 of the present embodiment is symmetric, explanation will be made hereinafter only as to one side. Further, in some cases, some components in each drawing are omitted for easy viewing.

The table 1 includes the top panel 11 and hollow columnar leg portions 13 that have a length in a vertical direction and hold the top panel.

Figure 2:
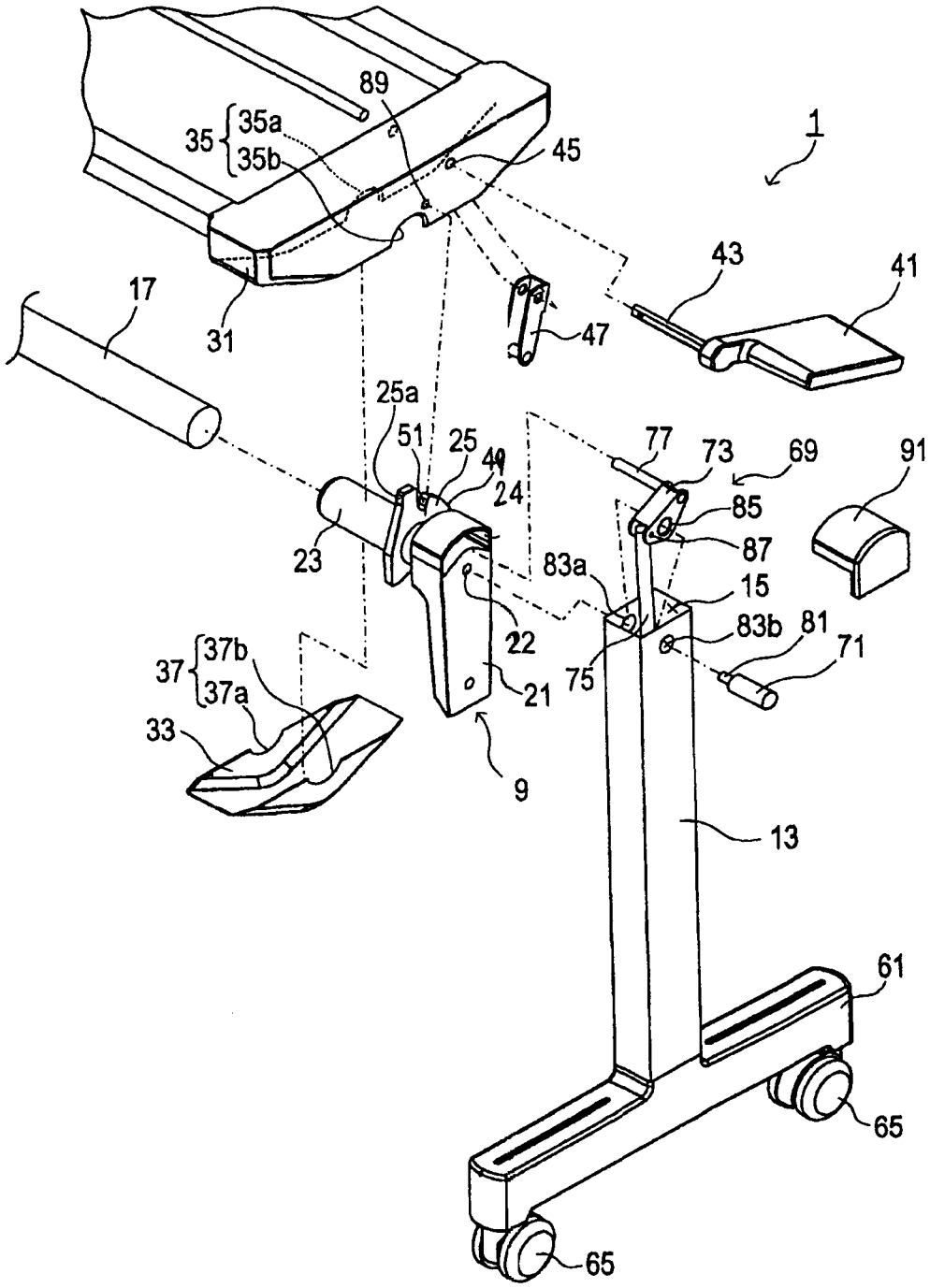
FIG. 2 is an exploded perspective view showing the table according to the embodiment of the present invention.

At the top end of the leg portion 13, an opening 15 is formed which opens in a vertical direction as shown in FIG. 2. The leg portion 13 is coupled to an opposite leg portion (not shown), which is a counterpart of the leg portion 13, by a frame 17. The frame 17 is an example of frame members of the present invention.

On the surface of the inside of the leg portion 13 (the insides of a pair of the leg portions), there is mounted a frame-holding portion 19. The frame-holding portion 19 includes a fixed portion 21 to be fixed to the leg portion 13, a cylindrical projecting portion 23 extending from the fixed portion 21 in a direction opposite to the leg portion 13, a plate-like lock receiver 25 provided on the projecting portion 23. The fixed portion 21 is fixed to the leg portion 13 with a support shaft 71 to be described below and a bolt (not shown) or the like. The projecting portion 23 is inserted into the frame 17 and fixed to the frame 17 with a bolt (not shown) or the like. The lock receiver 25 includes an engaging surface 25*a*, an abutting portion 49, and a groove 51 as will be described later.

On the back side of the top panel 11, there is mounted a top-panel-holding portion 31. The top-panel-holding portion 31 is configured so that a lid portion 33 can be mounted thereon. As shown in FIG. 2, the top-panel-holding portion 31 has semicircular notches 35 (35*a*, 35*b*) formed thereon. The lid portion 33 also has semicircular notches 37 (37*a*, 37*b*) formed thereon.

When the lid portion 33 is mounted on the top-panel-holding portion 31, the respective notch portions are combined together to form circular holes. The top panel 11 can be rotatably mounted about the frame 17 by assembling the top-panel-holding portion 31 and the lid portion 33 with the frame 17 sandwiched therebetween so that the frame 17 passes through the circular holes. Specifically, the hole formed with the notch 35*a* formed on the inside of the top-panel-holding portion 31 and the notch 37*a* formed on the inside of the lid portion 33 is positioned inside the lock receiver 25, and the hole formed with the notch 35*b* formed on the outside of the top-panel-holding portion 31 and the notch 37*b* formed on the outside of the lid portion 33 is positioned outside the lock receiver 25. The outside notches 35*b* and 37*b* are formed to have a diameter greater than that of the projecting portion 23. Therefore, the outer notch portions do not contact the projecting portion 23 under a condition in which the top-panel-holding portion 31 and the lid portion 33 are assembled together. As a result, the top panel 11 is held substantially only by the frame 17.

The top panel 11 is configured so that, when mounted on the frame 17, the center of gravity thereof is positioned on the axis line of the frame 17 when viewed from above.

The top-panel-holding portion 31 includes a contact piece 55 provided thereon which can abut against the engaging surface 25*a* of the lock receiver 25 in order to prevent the top panel 11 from rotating beyond the horizontal level.

At the outer side of the top-panel-holding portion 31, there is arranged a lever 41. The lever 41 includes a rotary shaft 43 provided thereon. The top-panel-holding portion 31 rotatably holds the rotary shaft 43 with a first through hole 45 provided on the outer side of the top-panel-holding portion 31. This allows the lever 41 to be held rotatably about the rotary shaft 43. The rotary shaft 43 includes a lock fitting 47 fixed thereon in such a manner as to form a substantially right angle with the lever, and the lock fitting 47 rotates in accordance with the rotation of the lever 41.

Figure 1B:
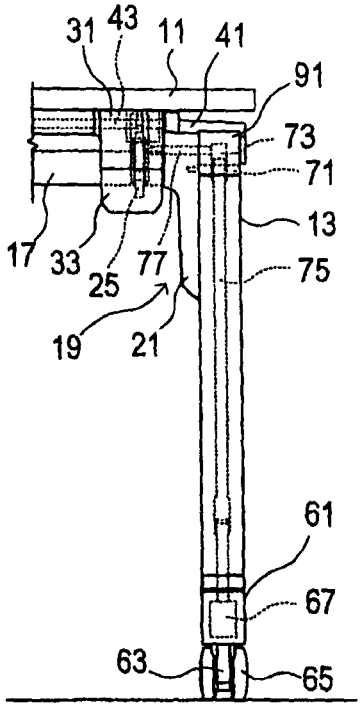
FIG. 1B is a front elevational view thereof.
Figure 1A:
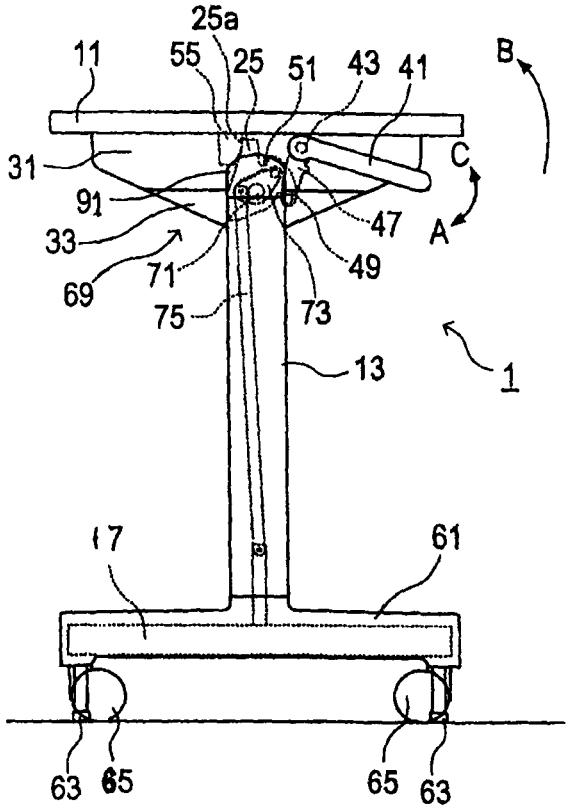
FIG. 1A is a side elevational view showing a table according to an embodiment of the present invention.

The rotary shaft 43 is urged by a spring (not shown) to rotate in a direction of an arrow A in FIG. 1A. That is, the lever 41 and the lock fitting 47 are also urged to rotate in the same direction. Therefore, when the lever 41 is not operated by the user, the lock fitting 47 is urged to move toward the side of the lock receiver 25 and, depending on the rotational state of the top panel 11, the lock fitting 47 comes into contact with the abutting portion 49 or the groove 51 to be engaged therewith, and such an engaging state is maintained.

FIG. 1A shows a state in which the lock fitting 47 abuts against the abutting portion 49, whereby the rotation of the top panel 11 in a direction of an arrow B is suppressed. The rotation in a direction opposite to that of the arrow B is suppressed by the contact of the contact piece 55 with the engaging surface 25*a* of the lock receiver 25.

Figure 3A:
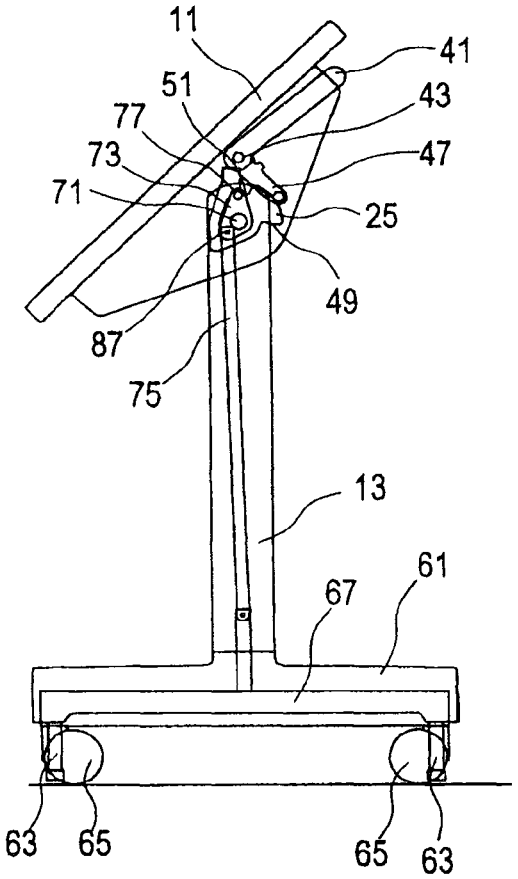
FIGS. 3A-3B are side elevational views for explaining rotational movement of a top panel.
Figure 3B:
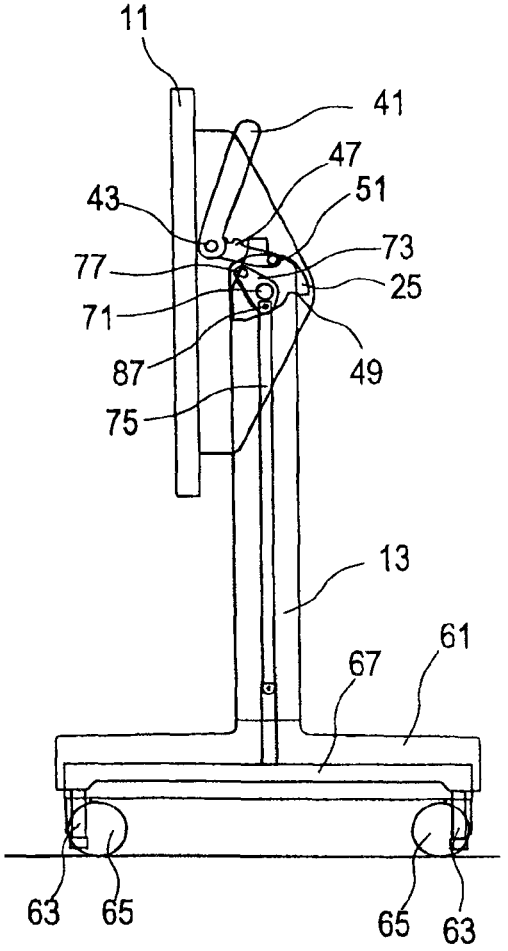

When the user moves the lever 41 in a direction of an arrow C against the urging force, the lock fitting 47 no longer abuts against the abutting portion 49 of the lock receiver 25 to allow the top panel 11 to be rotatable as shown in FIG. 3A. When the lever is released after the top panel 11 is rotated to an substantially vertical position, the lock fitting 47 is engaged with the groove 51 of the lock receiver 25 to suppress the rotation of the top panel 11 as shown in FIG. 3B.

The lock receiver 25 and the lock fitting 47 are arranged inside the combination of the top-panel-holding portion 31 and the lid portion 33.

A base portion 61 of the leg portion extends in a front-back direction (in a direction intersecting with a direction in which the leg portions are arranged), and contact portions 63 are projecting downward from both ends of the base portion 61. The movement of the table 1 is limited by contact of the contact portions 63 with the floor surface.

The base portion 61 includes a caster-supporting member 67 arranged thereinside which has casters 65 provided at the front and the rear thereof (in a side-to-side direction in FIG. 1A). The caster-supporting member 67 is configured to be raised/lowered in an interlocking manner with the rotation of the top panel 11 by means of a raising/lowering mechanism 69 to be described below. Specifically, when the top panel 11 is lying substantially horizontally as shown in FIG. 1A, the caster-supporting member 67 is moved upward, and due to the upward movement of the casters 65 relative to the contact portions 63, the contact portions 63 are brought into contact with the floor surface. In contrast, when the top panel 11 is set up substantially vertically as shown in FIG. 3B, the caster-supporting member 67 is moved downward, and due to the downward movement of the casters 65 relative to the contact portions 63, only the casters 65 are brought into contact with the floor surface, whereby the table 1 is made movable.

It is to be appreciated that a pair of the casters 65 arranged at the front and the rear is an example of the movable portion of the present invention. Specifically, the raising/lowering of the movable portion is achieved by raising/lowering the caster-supporting member 67.

(2) Configuration of the Raising/Lowering Mechanism

The raising/lowering mechanism 69 is a mechanism that transmits the rotation of the top panel 11 about the frame 17 to the caster-supporting member 67, and includes the support shaft 71, a rotary member 73, a rod 75, a top-panel-coupling member 77, and others.

As shown in FIG. 2, the support shaft 71 is a cylindrical member having a male screw 81 formed at one end thereof, and is inserted from a through hole 83, which is formed on the leg portion 13, to fixedly screw the leg portion 13 and the fixed portion 21. For this purpose, a female screw 22 is formed on the fixed portion 21. The support shaft 71 is arranged coaxially with the projecting portion 23 and the frame 17.

The rotary member 73 is a member formed of two substantially triangular plates connected to each other at the backs thereof. The rotary member 73 has a through hole 85 formed at both sides thereof, and the support shaft 71 is so arranged as to pass through the through hole 85. Due to such a configuration, the rotary member 73 becomes rotatable about the support shaft 71. The rotary member 73 may be configured of a single thick plate.

The upper end of the rod 75 is rotatably coupled to one end of the rotary member 73 with a shaft 87. The shaft 87 is arranged in parallel with the support shaft 71.

The rod 75 is arranged inside the leg portion 13 with the lower end thereof coupled to the caster-supporting member 67. Specifically, the caster-supporting member 67 is raised/lowered by raising/lowering the rod 75.

On the other end of the rotary member 73, one end of the top-panel-coupling member 77 is fixed. The top-panel-coupling member 77 is inserted through an arc-shaped through hole 24 provided on the fixed portion 21. The other end of the top-panel-coupling member 77 is inserted into a second through hole 89 of the top-panel-holding portion 31.

At the top of the leg portion 13, a cover member 91 is mounted which covers the opening 15 and the raising/lowering mechanism 69.

In the raising/lowering mechanism 69 configured as such, when the top-panel-holding portion 31 is rotated in accordance with the rotation of the top panel 11, the rotary member 73 coupled to the top-panel-holding portion 31 by the top-panel-coupling member 77 is rotated in accordance with the rotation of the top panel 11, whereby the rod 75 is moved up and down. Thus, the caster-supporting member 67 can be raised/lowered in an interlocking manner with the rotation of the top panel 11.

Figure 4A:
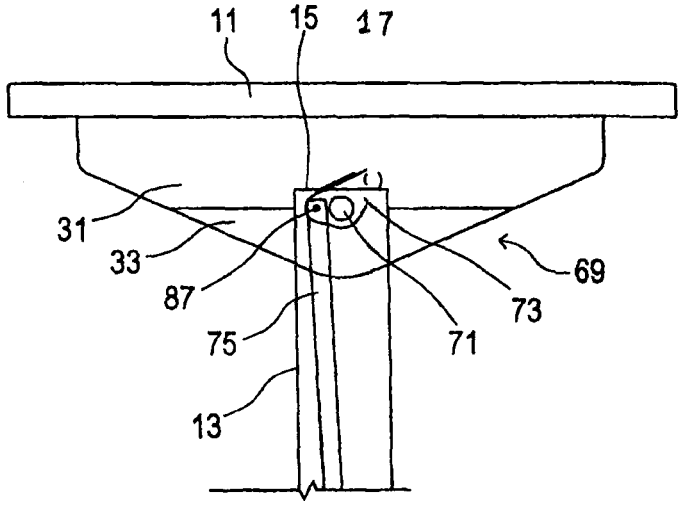
FIG. 4A is a side elevational view showing an enlarged raising/lowering mechanism and a periphery thereof.
Figure 4B:
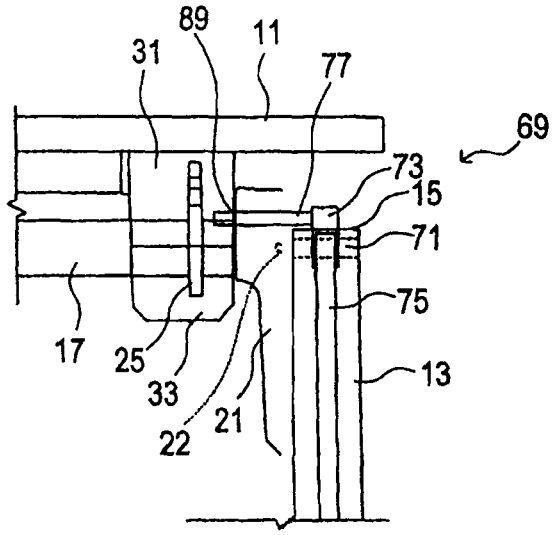
FIG. 4B is a front elevational view thereof.

FIGS. 4A and 4B show an enlarged raising/lowering mechanism 69 and periphery thereof shown in FIGS. 1A and 1B. It is to be appreciated that constituents other than the raising/lowering mechanism 69 are omitted as appropriate.

As can be seen in FIGS. 4A and 4B, the raising/lowering mechanism 69 couples the top panel 11 and the caster-supporting member 67 through the opening 15 of the leg portion 13. Further, the raising/lowering mechanism 69 is arranged on the side of the frame 17 (a rotation axis) in a direction of the axis line.

The rotary member 73, which converts the rotation of the top panel 11 to the raising/lowering movement of the rod 75, moves within a limited range centered on the vicinity of the rotation axis of the top panel 11. Such a configuration allows the raising/lowering mechanism 69 to be compact.

The top panel 11 and the leg portion 13 are arranged so that the axis line of the rotation axis of the top panel 11 passes through the center of the opening 15 when viewed from above.

As for an assembly of the table 1, it is preferable to preliminarily assemble the raising/lowering mechanism 69 on the leg portion 13 and insert the top-panel-coupling member 77 into the second through hole 89 of the top-panel-holding portion 31 at the site of assembly. Such an assembling method makes it easy to assemble the top panel 11 and the raising/lowering mechanism 69 together. Alternatively, it is possible to preliminarily assemble the top-panel-coupling member 77, which has been separated from the rotary member 73, on the top-panel-holding portion 31 and then fix the top-panel-coupling member 77 and the rotary member 73 to each other at the site of assembly.

(3) Effect of the Invention

In the table 1 of the present embodiment, since the raising/lowering mechanism 69 couples the top panel 11 and the caster-supporting member 67 through the opening 15 of the leg portion 13, it is not necessary to form holes or notches on the side of the leg portion 13 so as not to hinder the movement of the raising/lowering mechanism 69. As a result, the strength of the leg portion 13 can be kept high.

Further, since the components moving on the side of the leg portion 13 become unnecessary, a situation where the user's legs come into contact with such components does not occur. Accordingly, there is no possibility that a part of the use's body, clothes or the like may get caught in interspaces between the components and the structure of the leg portion 13 or the top panel 11, or in interspaces between the components and the holes or notches. In short, a risk of getting caught on the side of the leg portion 13 can be reduced.

In the table 1 of the present embodiment, the frame 17 can be arranged at the upper part to secure wider space for accommodating the user's legs.

Further, in the table 1 of the present embodiment, since the rotary member 73 and the top panel 11 rotate coaxially, the rotary member 73 rotates without changing the positional relationship thereof with the top panel 11. In a case where the positional relationship between the rotary member 73 and the top panel 11 varies, it is necessary to use a link mechanism or the like composed of a plurality of constituents as a component for coupling the rotary member 73 and the top panel 11. According to the configuration of the present embodiment, however, such a link mechanism or the like is not necessary and, therefore, a component that remains unchanged in formation, such as the top-panel-coupling member 77, can be used. This reduces a space for the movement of the top-panel-coupling member 77 in accordance with the rotation of the top panel 11 (i.e., a space required for the top-panel-coupling member 77 to move), whereby the top panel 11 and the caster-supporting member 67 can be easily coupled through the opening 15 of the leg portion 13. Additionally achieved are a space-saving design in the raising/lowering mechanism 69 and a reduced risk that a part of the user's body or the like gets caught in components sticking out of the leg portion 13.

Moreover, since the opening 15 and the raising/lowering mechanism 69 are covered with the cover member 91, when, for example, the top panel 11 is rotated, a part of the user's body or the like can be more surely prevented from getting caught in the opening 15 or the raising/lowering mechanism 69.

In the table 1 of the present embodiment, the top panel 11 is provided in such a manner that the center of gravity thereof is positioned on the axis line of the frame 17 when viewed from above. Although the top panel 11 is heavy in weight because a large area and a high strength are required, the table 1 is well balanced as a whole and can be used in a stable condition as long as the top panel 11 is held at just underneath the center of gravity. Further, since the top panel 11 is held on the frame 17 in a balanced manner, the top panel 11 can be rotated smoothly without the center of gravity thereof shifted in a front-back direction.

(4) Modified Embodiments

Although one embodiment of the present invention has been described as above, the present invention is not limited to the above embodiment. It is to be appreciated that the present invention can be implemented in various embodiments as far as they pertain to the technical scope of the present invention.

For example, although a configuration in which the support shaft 71 is arranged coaxially with the frame 17 is exemplified in the above embodiment, the support shaft 71 may be arranged non-coaxially. In such a case, the positional relationship between the top panel 11 and the rotary member 73 varies in accordance with the rotation of the top panel 11. Therefore, the top-panel-coupling member 77 may as well be so configured as to be able to follow such variation.

Further, although a configuration in which the casters 65 are raised/lowered in accordance with the rotation of the top panel 11 is exemplified in the above embodiment, a configuration is possible in which the contact portions 63 are raised/lowered. In such a raising/lowering mechanism, a relationship between the rotation of the top panel 11 and the raising/lowering of the rod 75 may as well be opposite to that in the above embodiment. Furthermore, although a configuration in which the casters 65 arranged at the front and the rear are concurrently moved is exemplified in the above embodiment, a configuration is possible in which either one of the casters constantly abuts against the floor surface and only the other is raised/lowered.

Figure 5A:
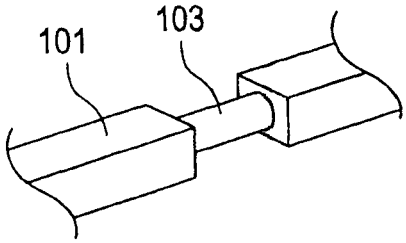
FIGS. 5A-5B are perspective views showing frames according to modified embodiments.
Figure 5B:
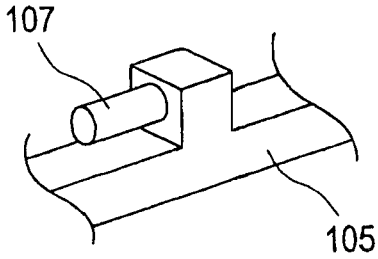

Moreover, although a configuration in which an entirely cylindrical member is used as the frame 17 is exemplified in the above embodiment, as long as a portion coupled to the top panel 11 (a portion sandwiched between the top-panel-holding portion 31 and the lid portion 33) is cylindrically formed, the other portions may be formed in any shapes. For example, a configuration is possible in which a frame 101 of prismatic shape has a cylindrical portion 103 of cylindrical shape only at a portion to be coupled to the top panel 11 as shown in FIG. 5A. Alternatively, a configuration is possible in which a cylindrical portion 107 of cylindrical shape is formed on a portion projecting from a frame 105 of prismatic shape as shown in FIG. 5B.

EXPLANATION OF REFERENCE NUMERALS

1 . . . table, 11 . . . top panel, 13 . . . leg portion, 15 . . . opening, 17 . . . frame, 19 . . . frame-holding portion, 21 . . . fixed portion, 23 . . . projecting portion, 25 . . . lock receiver, 31 . . . top-panel-holding portion, 33 . . . lid portion, 35 . . . notch, 37 . . . notch, 41 . . . lever, 43 . . . rotary shaft, 45 . . . first through hole, 47 . . . lock fitting, 49 . . . abutting portion, 51 . . . groove, 55 . . . contact piece, 61 . . . base portion, 63 . . . contact portion, 65 . . . caster, 67 . . . caster-supporting member, 69 . . . raising/lowering mechanism, 71 . . . support shaft, 73 . . . rotary member, 75 . . . rod, 77 . . . top-panel-coupling member, 81 . . . male screw, 83 . . . through hole, 85 . . . through hole, 87 . . . shaft, 89 . . . second through hole, 91 . . . cover member, 101 . . . frame, 103 . . . cylindrical portion, 105 . . . frame, 107 . . . cylindrical portion

What is claimed is:

1. A table comprising:

a pair of leg portions, and each of the leg portions has a length in a vertical direction and is hollow in shape with an opening formed at a top end thereof;

a top panel that is rotatably mounted;

a pair of casters, at least one of the pair of casters being provided at each of a front and a rear of a base portion of each leg portion;

a contact portion provided on the base portion of each leg portion; and a raising/lowering mechanism that couples a movable portion, which is either one or more of the pair of casters and the contact portion, to the top panel, and switches which of the pair of casters and the contact portion comes into contact with a floor surface by raising/lowering the movable portion in accordance with a rotation of the top panel, wherein an upper end of the raising/lowering mechanism extends through and partialy projects out from the opening formed at the top end of each of the leg portions, the upper end of the raising/lowering mechanism couples, via the opening formed at the top end of each of the leg portions, the top panel to the movable portion.

2. The table according to claim 1, comprising a frame member that couples the pair of leg portions, at least a part of the frame member being formed as a cylindrical portion of cylindrical shape, and wherein the top panel rotates about the cylindrical portion.

3. The table according to claim 2, wherein the raising/lowering mechanism comprises:

a top-panel-coupling member that couples to the top panel;

a rod that is arranged inside each leg portion and couples to the movable portion;

a support shaft that is fixed to each leg portion in parallel with an axis line of a rotation axis of the top panel; and a rotary member that is rotatably supported by the support shaft and couples to the top-panel-coupling member and to the rod, wherein the support shaft is arranged substantially coaxially with the cylindrical portion.

4. The table according to claim 1, wherein the raising/lowering mechanism comprises:

a top-panel-coupling member that is coupled to the top panel;

a rod that is arranged inside each leg portion and is coupled to the movable portion;

a support shaft that is fixed to each leg portion in parallel with an axis line of a rotation axis of the top panel; and a rotary member that is rotatably supported by the support shaft and is coupled to the top-panel-coupling member and to the rod.

5. The table according to claim 1, wherein the top panel and each leg portion are arranged in such a manner that an axis line of a rotation axis of the top panel passes through a center of the opening when viewed from above.

6. The table according to claim 1, comprising a cover member that covers a top of each leg portion and the raising/lowering mechanism.

7. The table according to claim 1, wherein a center of gravity of the top panel is positioned on an axis line of a rotation axis of the top panel when viewed from above.

8. A table comprising:

a pair of leg portions, and each of the leg portions has a length in a vertical direction and is hollow in shape with an opening formed at a top end thereof;

a frame member that couples the pair of leg portions, at least a part of the frame member being formed as a cylindrical portion of cylindrical shape;

a top panel that is rotatable about the cylindrical portion;

a pair of casters, at least one of the pair of casters being provided at each of a front and a rear of a base portion of each leg portion;

a contact portion provided on the base portion of each leg portion; and a raising/lowering mechanism that couples a movable portion, which is either one or more of the pair of casters and the contact portion, to the top panel, and switches which of the pair of casters and the contact portion comes into contact with a floor surface by raising/lowering the movable portion in accordance with a rotation of the top panel, wherein the raising/lowering mechanism comprises:

a top-panel-coupling member that is coupled to the top panel;

a rod that is arranged inside each leg portion and is coupled to the movable portion;

a support shaft that is fixed to each leg portion in parallel with an axis line of the cylindrical portion;

a rotary member that is rotatably supported by the support shaft and is coupled to the top-panel-coupling member and to the rod, and the support shaft is arranged substantially coaxially with the cylindrical portion.

9. The table according to claim 8, wherein the top panel and each leg portion are arranged in such a manner that an axis line of a rotation axis of the top panel passes through a center of the opening when viewed from above.

10. The table according to claim 8, comprising a cover member that covers a top of each leg portion and the raising/lowering mechanism.

11. The table according to claim 8, wherein a center of gravity of the top panel is positioned on an axis line of a rotation axis of the top panel when viewed from above.

12. A method of assembling a table, wherein the table comprises:

a pair of leg portions that each has a length in a vertical direction and is hollow in shape with an opening formed at a top end thereof;

a frame member that couples the pair of leg portions, at least a part of the frame member being formed as a cylindrical portion of cylindrical shape;

a top panel that is rotatable about the cylindrical portion;

a pair of casters, at least one of the pair of casters being provided at each of a front and a rear of a base portion of each leg portion;

a contact portion provided on the base portion of each leg portion; and a raising/lowering mechanism that couples a movable portion, which is either one or more of the pair of casters and the contact portion, to the top panel via the opening, and switches which of the pair of casters and the contact portion comes into contact with a floor surface by raising/lowering the movable portion in accordance with a rotation of the top panel, wherein a first end of the raising/lowering mechanism extends through and partially projects out from the opening formed at the top end of each of the leg portions, and the raising/lowering mechanism comprises:

a top-panel-coupling member that is coupled to the top panel;

a rod that is arranged inside each leg portion and is coupled to the movable portion;

a support shaft that is fixed to each leg portion in parallel with an axis line of a rotation axis of the top panel; and a rotary member that is rotatably supported by the support shaft and is coupled to the top-panel-coupling member and to the rod, and the method of assembling the table comprises steps of:

preliminarily assembling the top-panel-coupling member on either one of the top panel or the rotary member; and coupling the raising/lowering mechanism and the top panel by inserting the top-panel-coupling member into an inserted portion formed on another of the top panel and the rotary member in such a manner as to move the top-panel-coupling member in parallel with the axis line of the rotation axis of the top panel.

* * * * *